US009305529B1

(12) United States Patent
Paounov

(10) Patent No.: US 9,305,529 B1
(45) Date of Patent: Apr. 5, 2016

(54) GUITAR REST

(71) Applicant: Vihren Paounov, Sofia (BG)

(72) Inventor: Vihren Paounov, Sofia (BG)

( * ) Notice: Subject to any disclaimer, the term of this patent is extended or adjusted under 35 U.S.C. 154(b) by 0 days.

(21) Appl. No.: 14/640,158

(22) Filed: Mar. 6, 2015

(51) Int. Cl.
*G10D 3/00* (2006.01)
*G10G 5/00* (2006.01)
*G10D 1/08* (2006.01)

(52) U.S. Cl.
CPC ... *G10G 5/00* (2013.01); *G10D 1/08* (2013.01)

(58) Field of Classification Search
CPC ..... G10G 5/00
See application file for complete search history.

(56) References Cited

U.S. PATENT DOCUMENTS 1,669,523 A * 5/1928 Isecoff ..... G10G 5/00 24/331
6,127,612 A * 10/2000 Yu ..... G10G 5/00 84/327
6,439,532 B1 * 8/2002 Yu ..... G10G 5/00 248/122.1
7,423,209 B2 * 9/2008 Chen ..... G10G 5/00 248/470
7,464,910 B1 * 12/2008 St. Germain ..... G10G 5/00 211/85.6
7,484,701 B2 * 2/2009 Hsieh ..... A47F 5/0853 211/106.01
7,547,835 B1 * 6/2009 Mayor ..... G10G 5/00 84/327
7,906,717 B2 * 3/2011 Wang ..... G10G 5/00 248/121
8,490,942 B1 * 7/2013 Henry ..... A47B 19/00 206/314
8,636,255 B2 * 1/2014 Rodrigues ..... G10G 5/00 248/154
8,763,961 B1 * 7/2014 Yang ..... G10G 5/00 248/122.1
8,925,890 B2 * 1/2015 Liaw ..... G10G 5/00 211/85.6
9,016,640 B2 * 4/2015 Sawhney ..... F16M 11/20 206/314
2005/0011337 A1 * 1/2005 Hsieh ..... F16M 11/02 84/327
2007/0001081 A1 * 1/2007 Wallis ..... G10G 5/00 248/312
2011/0303804 A1 * 12/2011 Rodrigues ..... G10G 5/00 248/122.1

* cited by examiner

*Primary Examiner* — Robert W Horn

(57) ABSTRACT

Guitar rest is a portable devise which secures itself onto a guitar neck and provides additional support to a guitar when said guitar is leaning on a vertical surface such as a wall. Such state of leaning is to be understood as the most common practice of vertically resting a guitar on the floor and then leaning the neck of said guitar on an adjacent wall. It is to be understood that said surface is free of any additional parts or aids mounted onto it in order to aid Guitar rest. In this sense Guitar rest is a free-standing devise. Guitar rest can generally be described as being comprised of a neck support unit and a wall rest unit. The neck support unit is designed to grip onto the guitar neck while the wall rest unit comprises a pair of arms by means of which contact and stability at said vertical surface is achieved.

1 Claim, 6 Drawing Sheets

GUITAR REST

BACKGROUND OF THE INVENTION

Guitar rest generally relates to means of supporting a guitar for storage-display. Commonly, a guitar leaning on a wall will lose balance, slide along the wall and drop to the floor unless perfect balance is achieved. By means of friction and mechanics build into the design, Guitar rest provides a secure connection between the guitar neck and said adjacent wall without otherwise having to search for perfect balance. By using the invention, balance is found as easily as would be when using a conventional free-standing guitar stand. To my knowledge, in the prior art, a free standing device allowing a safe storage of the guitar by means of leaning it on a wall does not yet exist.

In substance, guitar rest comprises a neck support unit and a wall rest unit. The neck support is adjustable to accommodate various guitar neck sizes and also provides a solid connection at the guitar neck. The wall rest unit serves as an extension to the neck support unit and comprises two arms which contact said vertical surface thus securing the guitar as it leans towards a wall. There are numerous solutions for placing a guitar in a vertical (semi-vertical) position. To my knowledge all free-standing guitar stands rely on design, which excludes the existence of a wall. In my experience it is more often than not when a guitar is propped on a wall simply because it is convenient. However often times the guitar will lose balance, slide along the wall and crush on the floor. This invention solves this problem. In comparison this invention is smaller and lighter than any free-standing guitar stand thus making it easy to handle and transport. My study and knowledge of the art show that to date, there is no free standing guitar stand which helps achieve balance when leaning a guitar on a wall.

BRIEF SUMMARY OF THE INVENTION

As a guitar is leaning toward a wall, Guitar rest creates two points of support to the wall and a support point to the neck of the guitar. These three points form a somewhat horizontal triangle. The two points of contact to the wall are additionally secured against slippage by rubber tips. Fulcrum to the neck of the guitar is achieved thanks to a design, which firmly grips the guitar neck at this point. The fulcrum can be found randomly along the guitar neck.

Due to its design, Guitar rest remains attached to the neck, even when the neck is separated from the wall. This is for the purpose of restoring balance should the guitar be accidentally pushed. Guitar rest is released from the neck with a movement like grip pliers.

DETAILED DESCRIPTION OF THE PREFERRED EMBODIMENT

Figure 1:
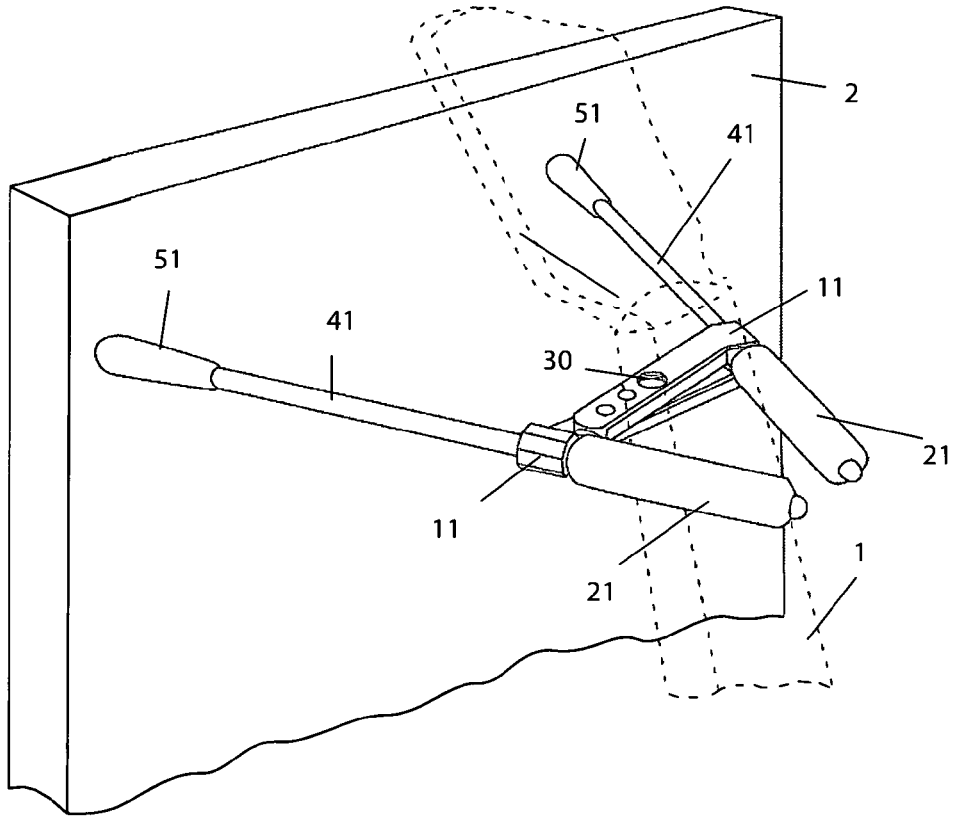
FIG. 1 is an embodied perspective view of the invention. It also shows the invention in use.

FIG. 1 shows the invention as it is used. The dashed line represents a guitar neck. The body of the guitar (not shown) is assumed to be touching the ground and is to be envisioned as residing in the area past the lower border of FIG. 1. Guitar neck 1 is secured in the neck support unit comprising arms 11, 21 and pivot 30. Pivot 30 connects arms 11 and allows rotation with a degree of friction between arms 11. Arms 11 are made of durable material the likes of PP. The material is chosen so as to further contribute to the friction factor between arms 11. The friction between arms 11 insures that guitar rest remains attached to the guitar neck until the user disconnects it. Arms 21 are made of foam-rubber tubing mounted around a durable rod core. There is a degree of friction between arms 21 and neck 1 as well. As it will be seen in FIG. 2, said core in this embodiment is arm 41. Disconnecting is done by holding guitar rest's arms 41 in one hand similar to holding a pair of pliers. By squeezing parts 41 toward each other, guitar rest releases neck 1.

Figure 2:
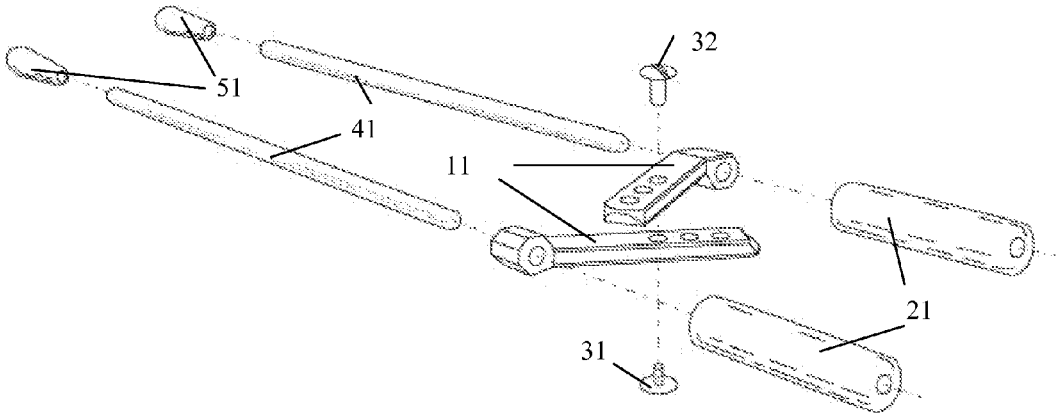
FIG. 2 is an exploded perspective view of the invention.

FIG. 2 is an exploded view of the invention. Rubber tips 51 mount onto arms 41. Arms 41 slide onto the opening of arms 11. Another option would be for arms 11 to be injection molded around arms 41. Arms 21 slide onto arms 11. Pivot 31 and 32 tread into each other thus mounting arms 11 together.

Figure 3:
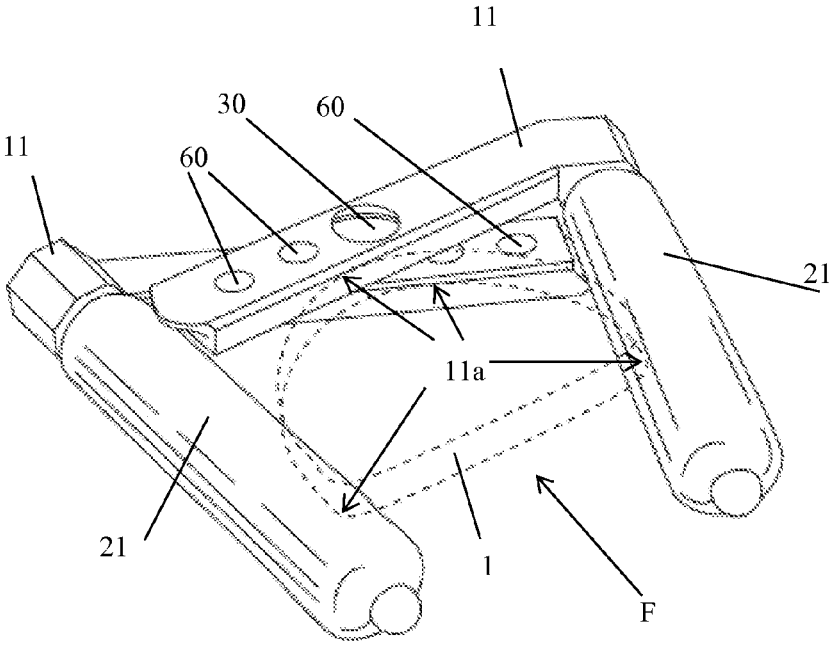
FIG. 3 is a perspective view of the neck support unit.

FIG. 3 further illustrates the locking effect of the neck support unit. The dotted segment represents a cross section of the guitar neck. To better illustrate the mechanics of the guitar support unit it is assumed that pivot 30 is anchored. Arrows 11*a* point at the four areas of contact between the guitar neck and the neck support unit. When leaning toward a wall, neck 1 applies force in the direction of arrow F, arms 11 rotate around pivot 30 causing the distance between arms 21 to shorten. This in turn secures the guitar neck into place.

Herein with numerical 60 are represented optional pivotal openings. These are to accommodate different neck sizes and it's understood they may vary in number. Pivot 30 can be inserted into chosen openings 60 as desired. Pivot 30 is comprised of two parts numbered 31 in FIG. 2 Said two parts are coupled by means of threading. The two parts have a slit to allow securing and dismounting of pivot 30 (FIG. 3) with a coin. Depending on the width of the, neck different pivot positions can be chosen. In this presentation the invention is shown as it would be set in order to accommodate the narrower models on the market.

Back to FIG. 1, the wall rest unit is comprised of arms 41 and rubber tips 51. The rubber tips 51 and 52 provide friction to the wall; the rods 41 are made of steel and provide strength and elasticity at the same time. As arm 11 and 21 rotate toward each other around pivot 30 the distance between tips 51 increases.

In FIG. 2 can be seen that rods 41, in this embodiment, serve also as the rod core for arms 21 as described in FIG. 1.

Arms 11 can be injection molded around core 41 or casted separately. Parts 21 and 51 are respectively injection molded onto arm 41 or manufactured separately and then secured around 41 by means of friction. Parts 31 and 32 thread into each other to become pivot 30 (see FIG. 1).

Figure 4:
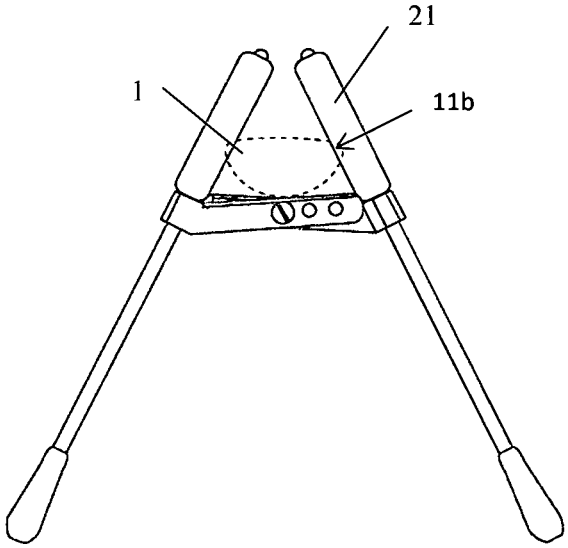
FIG. 4 is an embodied top view of the invention.

FIG. 4 is a top view if the invention. The dotted line is as a cross section of the guitar neck 1. The arrow points at the area of interaction between guitar neck 1 and arms 21. Arms 21 are made of material soft enough to allow guitar neck 1 to sink into arm 21. The amount of this deformation of 21 is the common area of intersection between 21 and 1.

Figure 5:
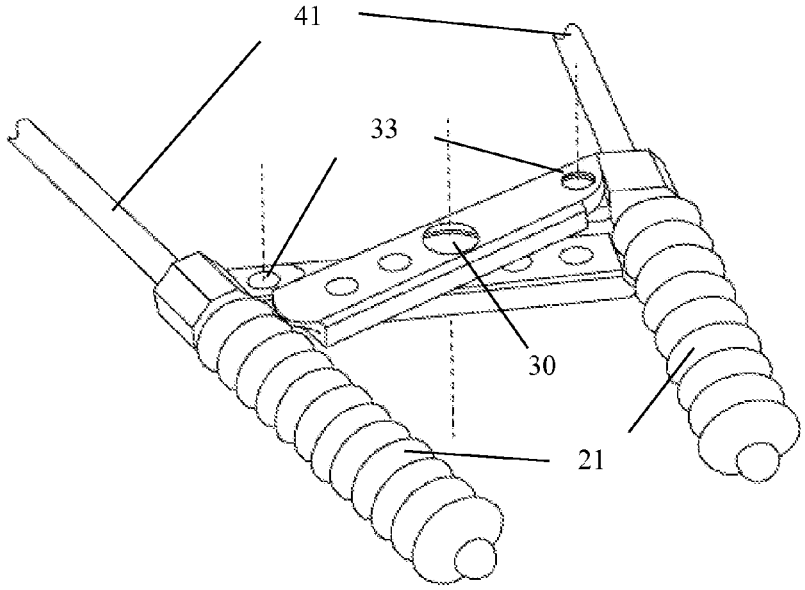
FIG. 5 is an alternative to the presented embodiment.

FIG. 5 is perspective view of an alternative construction of the invention. This alternative allows for more compact folding-storing of the invention as well as it provides additional security of the guitar neck by means of altering arms 21 as shown. Arms 41 are shown cut off.

The vertical dotted lines represent the rotation axis of pivots 33 and 30. Pivots 33 allow arms 11 to fold parallel to arms

21. It is understood that arms 11 unfold back to a limit, such limit being shown herein FIG. 5. The grooves seen on part 21 help with securing Guitar rest onto the neck of the guitar.

Figure 6:
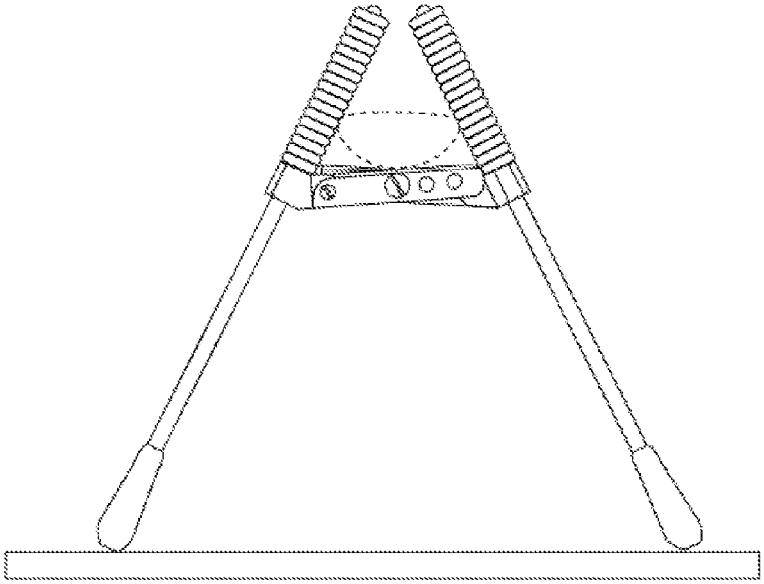
FIG. 6 is a top view of the alternative embodiment.

FIG. 6 is a top view of the alternative embodiment of the invention as it is being used. The dotted line represents a cross section of the guitar neck.

Figure 7:
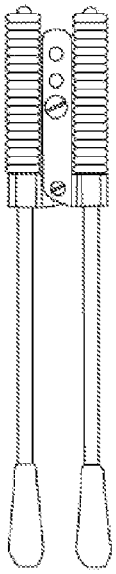
FIG. 7 is a top view of the alternative embodiment as it is folded for storage.

FIG. 7 is a top view of the invention as it is folded and is in a state of not being used.

Normally Guitar rest is first secured around the guitar neck and then the guitar is rested on a wall.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

The invention claimed is:

1. A guitar rest that is free-standing provides additional support when leaning a guitar on a vertical surface wherein said guitar rest comprises a neck support unit and a wall rest unit; the neck support unit provides a fulcrum at the guitar neck and is adjustable in order to accommodate different guitar neck width; the wall rest unit comprises two arms each of whom is connected to the neck support unit at one end, while the other ends provide two points of friction when contacting said vertical plane; said two points of friction and said fulcrum form a triangle the base of which is wide enough to provide support for the fulcrum.

* * * * *